US011600435B2

(12) United States Patent
Scheleski et al.

(10) Patent No.: US 11,600,435 B2
(45) Date of Patent: Mar. 7, 2023

(54) COIL BOBBIN FOR A BALANCED ARMATURE RECEIVER

(71) Applicant: Knowles Electronics, LLC, Itasca, IL (US)

(72) Inventors: Richard Scheleski, Naperville, IL (US); Yahui Zhang, Schaumburg, IL (US); Matthew Manley, Crystal Lake, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 17/139,305

(22) Filed: Dec. 31, 2020

(65) Prior Publication Data

US 2022/0208441 A1 Jun. 30, 2022

(51) Int. Cl.

| | |
|---|---|
| ***H01F 27/32*** | (2006.01) |
| ***H01H 50/30*** | (2006.01) |
| ***H04R 1/10*** | (2006.01) |
| ***H04R 11/02*** | (2006.01) |
| ***H04R 1/06*** | (2006.01) |

(52) U.S. Cl.
CPC ..... *H01F 27/325* (2013.01); *H01H 50/30* (2013.01); *H04R 1/06* (2013.01); *H04R 1/1066* (2013.01); *H04R 11/02* (2013.01)

(58) Field of Classification Search
CPC ..... H04R 9/025; H04R 9/027
See application file for complete search history.

(56) References Cited

U.S. PATENT DOCUMENTS

| | | | | |
|---|---|---|---|---|
| 1,790,528 A | | 1/1931 | Babcock | |
| 1,822,095 A | | 9/1931 | High | |
| 3,671,684 A | * | 6/1972 | Tibbetts | H04R 11/00 381/189 |
| 3,838,216 A | | 9/1974 | Watkins | |
| 4,016,376 A | * | 4/1977 | Neuhof | H04R 13/00 340/384.73 |

(Continued)

FOREIGN PATENT DOCUMENTS

| | | |
|---|---|---|
| CN | 211152205 U | 7/2020 |
| CN | 211209921 U | 8/2020 |

(Continued)

OTHER PUBLICATIONS

Warren, Daniel et al.; U.S. Appl. No. 62/047,099, filed Sep. 8, 2014.

(Continued)

*Primary Examiner* — Suhan Ni

(57) ABSTRACT

Coil bobbins for balanced armature receivers are disclosed. The balanced armature receiver bobbin includes a coil support member, at least two flanges, and a shoulder. The coil support member has an armature passage extending between a first end and a second end thereof. The flanges extending radially from the coil support member such that the first flange extends from the coil support member proximate the first end and the second flange extends from the coil support member proximate the second end. The shoulder extends from the first flange, with the first flange located between the shoulder and the coil support member. The shoulder has a plurality of conductive coil pads disposed on a bottom portion thereof.

19 Claims, 6 Drawing Sheets

(56) References Cited

U.S. PATENT DOCUMENTS

| | | | | |
|---|---|---|---|---|
| 4,504,704 | A | 3/1985 | Ohyaba et al. | |
| 5,216,723 | A | 6/1993 | Froeschle et al. | |
| 5,610,989 | A | 3/1997 | Salvage et al. | |
| 5,708,721 | A | 1/1998 | Salvage et al. | |
| 7,050,602 | B2 | 5/2006 | Miller et al. | |
| 7,639,829 | B2 * | 12/2009 | Husung ..... | H04R 25/554 381/409 |
| 9,872,019 | B2 | 1/2018 | Song et al. | |
| 2005/0123166 | A1 | 6/2005 | Chen et al. | |
| 2016/0044420 | A1 | 2/2016 | Albahri et al. | |
| 2021/0204064 | A1 | 7/2021 | Zhang et al. | |
| 2021/0266673 | A1 * | 8/2021 | Wang ..... | H04R 9/025 |

FOREIGN PATENT DOCUMENTS

| | | |
|---|---|---|
| PH | 22020050740 | 3/2022 |
| PH | 22020050739 | 5/2022 |
| PH | 22020050757 | 6/2022 |

OTHER PUBLICATIONS

Warren, Daniel et al.; U.S. Appl. No. 62/047,101, filed Sep. 8, 2014.
Warren, Daniel et al.; U.S. Appl. No. 62/047,157, filed Sep. 8, 2014.
Warren, Daniel et al.; U.S. Appl. No. 62/047,104, filed Sep. 8, 2014.
Warren, Daniel et al.; U.S. Appl. No. 62/047,112, filed Sep. 8, 2014.
Warren, Daniel et al.; U.S. Appl. No. 62/047,121, filed Sep. 8, 2014.
Warren, Daniel et al.; U.S. Appl. No. 62/047,129, filed Sep. 8, 2014.
Warren, Daniel et al.; U.S. Appl. No. 62/047,140, filed Sep. 8, 2014.
Knowles IPC(M) SDN. BHD.; PH Application No. 22020050755; filed Dec. 22, 2020.

* cited by examiner

COIL BOBBIN FOR A BALANCED ARMATURE RECEIVER

TECHNICAL FIELD

This disclosure relates generally to balanced armature receivers and more specifically to coil bobbins and subassemblies used in such receivers.

BACKGROUND

Many hearing instruments such as hearing aids, earphones, and personal audio headsets, among other devices include one or more balanced armature receivers, also referred to herein as "acoustic receivers" or "receivers". Such receivers generally comprise a case or housing containing a diaphragm that divides an interior of the housing into front and back volumes. A motor located in the back volume includes an electrical coil with a passage through which an armature (also called a reed) is disposed. The armature has a stationary end fixed to a yoke and another end movably disposed between magnets supported by the yoke. A drive rod or other link couples the armature to the diaphragm. In operation, an electrical signal applied to the electrical coil causes the armature to vibrate between the magnets. The vibrating armature moves the diaphragm, resulting in emission of sound from an aperture in the front volume of the housing. In some acoustic receivers, the coil includes an insulated wire wound about a bobbin having a passage through which the armature extends. However, connecting the coil wires to heavier gauge wire soldered to an external terminal board is laborious and can be costly.

Figure 1:
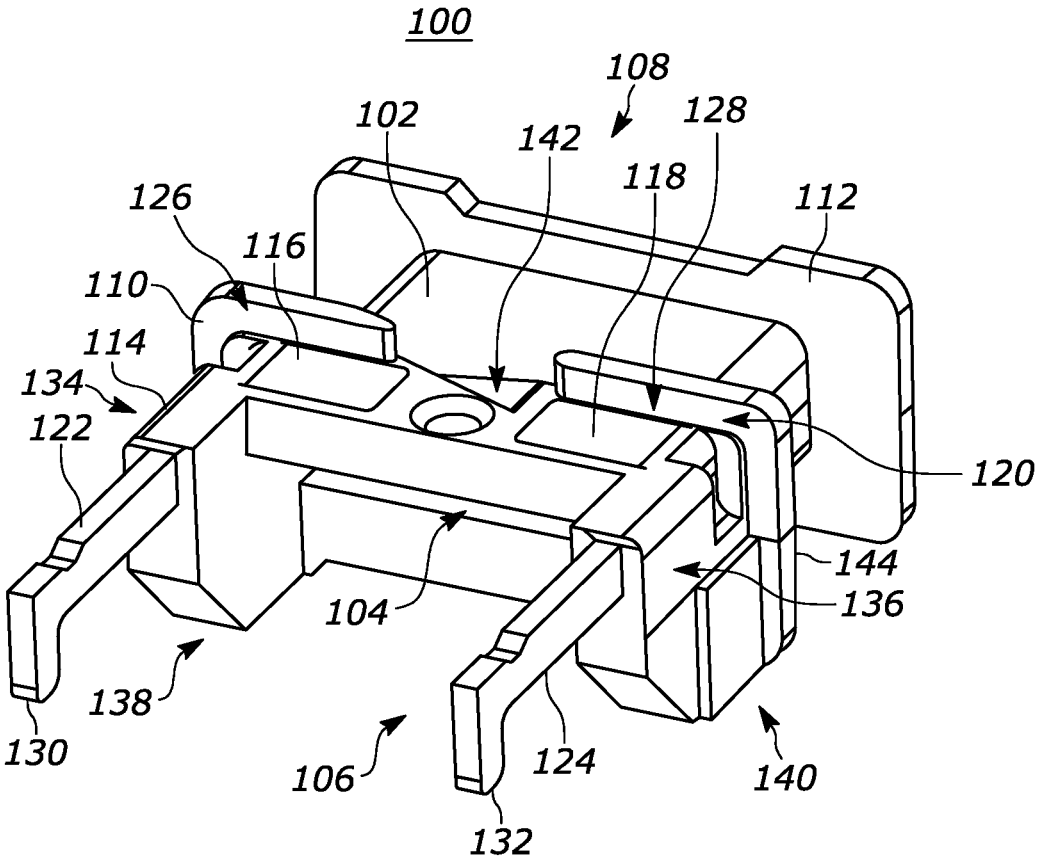
FIG. 1 is a perspective view a coil bobbin according to one embodiment.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have meanings accorded to such terms and expressions by those having ordinary skill in the art except where specific meanings have otherwise been set forth herein.

DETAILED DESCRIPTION

The present disclosure pertains to coil bobbins for balanced armature receivers. Such receivers are typically integrated in hearing aids and other hearing devices, such as behind-the-ear (BTE) devices with a portion that extends into or on the ear, in-the-canal (ITC) or partially in the ear canal devices, receiver-in-canal (RIC) devices, headsets, wired or wireless in-the-ear (ITE) earbuds or earpieces, among other devices that produce an acoustic output signal in response to an electrical input signal and intended are for use on, in, or in close proximity to a user's ear.

In FIGS. 1-3, 7, and 11, a balanced armature receiver bobbin 100 comprises a coil support member 102 having an armature passage 104 extending between a first end 106 and a second end 108 of the bobbin. The bobbin includes at least a first flange 110 and a second flange 112 extending from the coil support member. The first flange extends from the coil support member proximate the first end and the second flange extends from the coil support member proximate the second end of the bobbin. The flanges may be referred to as protrusions, projections, extensions, rims, or lips, as appropriate. The flanges can be parallel or non-parallel with respect to each other. In some embodiments, the flanges are monolithic or unitary with respect to the coil support member of the bobbin.

Figure 3:
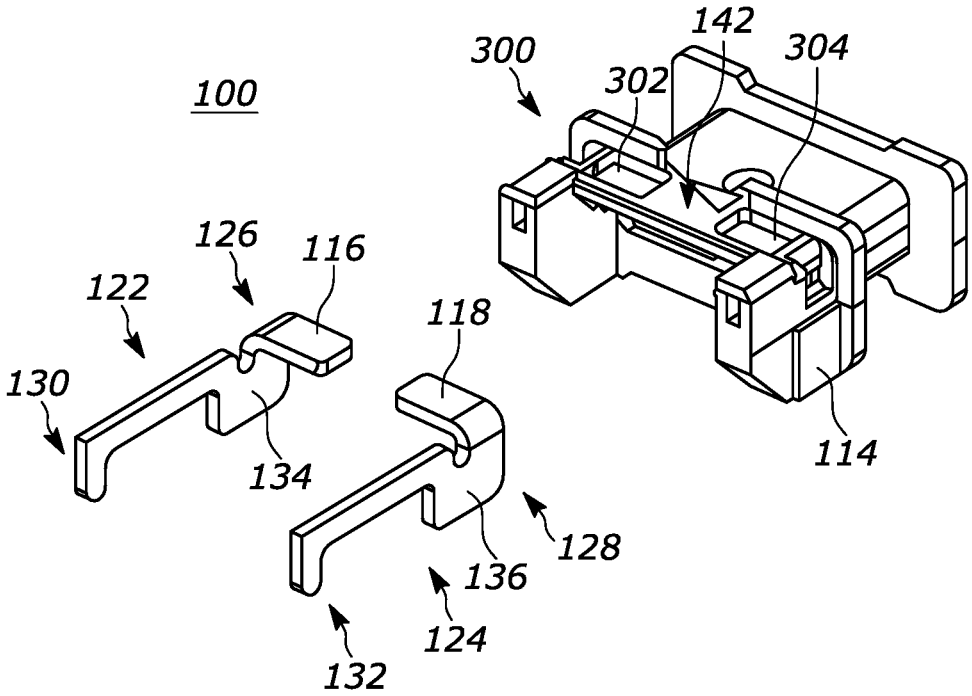
FIG. 3 is an exploded view of the bobbin of FIG. 1.

In FIGS. 1 and 3, the bobbin also comprises a shoulder 114 extending from the first flange 110, wherein the first flange is located between the shoulder and the coil support member. The shoulder has a plurality of conductive coil pads 116 and 118 disposed on a bottom portion 120 of the shoulder. The coil support member, flanges and shoulder can be an unassembled unitary member formed of a non-conductive material such as plastic, porcelain, or ceramic, among others. The coil bobbin can be formed by any suitable manufacturing process such as molding, or casting, among others.

Figure 2:
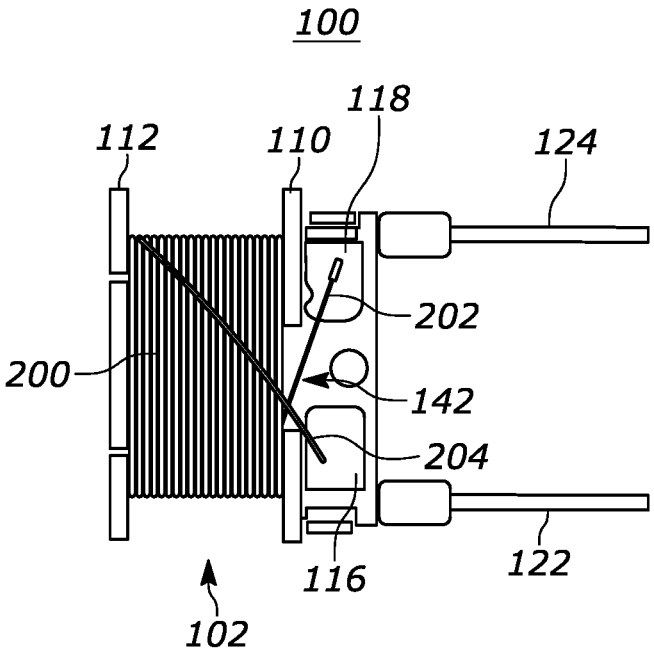
FIG. 2 is a bottom view of the bobbin of FIG. 1 with a coil wound therearound.

In FIG. 2, the coil support member is the portion of the bobbin about which a coil is wrapped and end portions of the coil are electrically coupled to the coil pads. The bobbin can also include a plurality of electrical terminals 122 and 124, which may also be referred to as "pins", partially embedded in the shoulder. Although only two terminals are shown, the embodiments described herein can contain any suitable number of electrical terminals as deemed appropriate in an acoustic receiver application.

In FIGS. 1 and 3, each electrical terminals has a first end and a second end. That is, the electrical terminal 122 has a first end 126 and a second end 130, and the electrical terminal 124 has a first end 128 and a second end 132. The first ends of the terminals include the conductive coil pads 116 and 118. As such, each conductive coil pad is defined as a part of an electrical terminal. Such terminals can be formed in a metal stamping and forming operation. The second ends of the terminals extend or protrude longitudinally from the shoulder 114. The terminals are located on opposite sides 138 and 140 of the armature passage 104. The terminals can be insert molded within, or over molded by, the bobbin body. The unitary member 300 includes recesses or indentations 302 and 304 on a surface of the bottom portion of the shoulder, wherein the coil pads are located at least partially in the recesses.

In FIGS. 1, 2, 4, 5, 7, 8 and 11, the shoulder 114 surrounds (or alternatively, covers embeds, or encapsulates) all sides of a portion of each of the plurality of electrical terminals 122 and 124. In FIG. 1, such portions are shown as surrounded portions 134 and 136. The surrounded portion is located between the first end 126 and the second end 130 of the terminal 122. The surrounded portion 136 is located between the first end 128 and the second end 132 of the terminal 124. Because they are surrounded on all sides by the shoulder, the surrounded portions are not be visible when the terminals combined with the bobbin. Fully encapsulating a portion of the terminals provides greater stability and precise positioning of the terminals within the body portion of the bobbin.

In FIG. 2, a coil 200 is disposed about the coil support member 102 between the flanges 110 and 112. The coil has two ends or wire portions 202 and 204 electrically coupled to a corresponding one of the conductive coil pads 116 and 118. Although the wire portion 202 is shown to be coupled to the coil pad 118 and the wire portion 204 is shown to be coupled to the coil pad 116, the reverse is also possible in other examples. The electrical coupling can be achieved and maintained using any suitable means of attachment, including but not limited to gluing, welding, soldering, etc.

Figure 4:
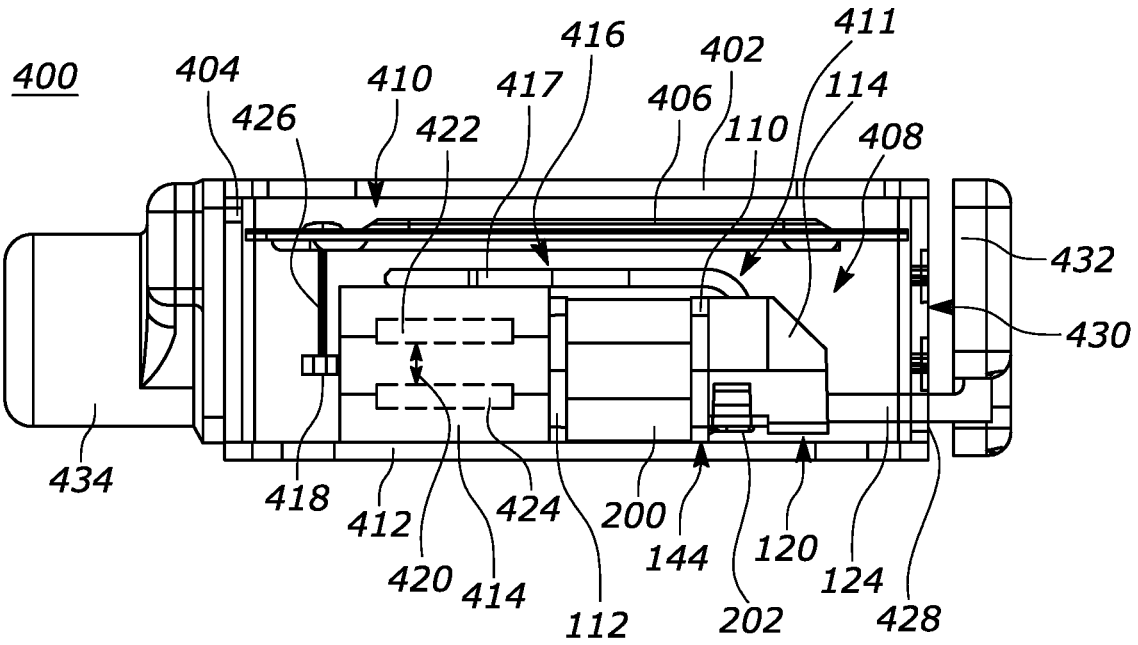
FIG. 4 is a partial side sectional view of a balanced armature receiver including the bobbin of FIG. 1.
Figure 5:
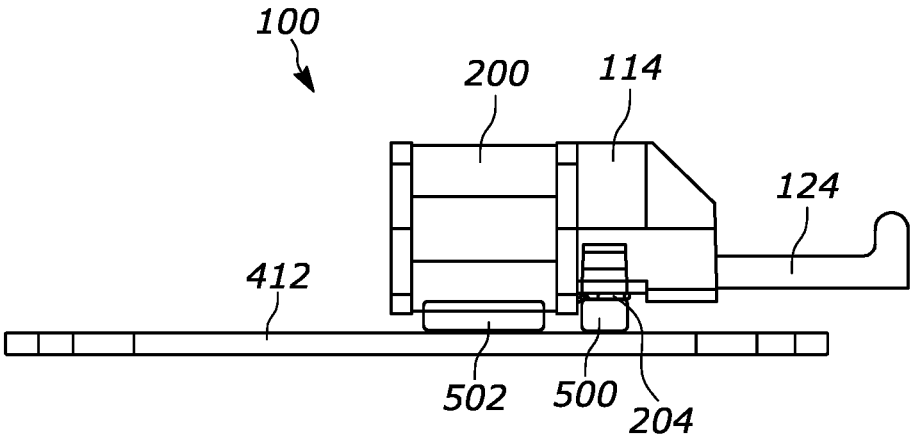
FIG. 5 is a partial view of the balanced armature receiver subassembly.
Figure 8:
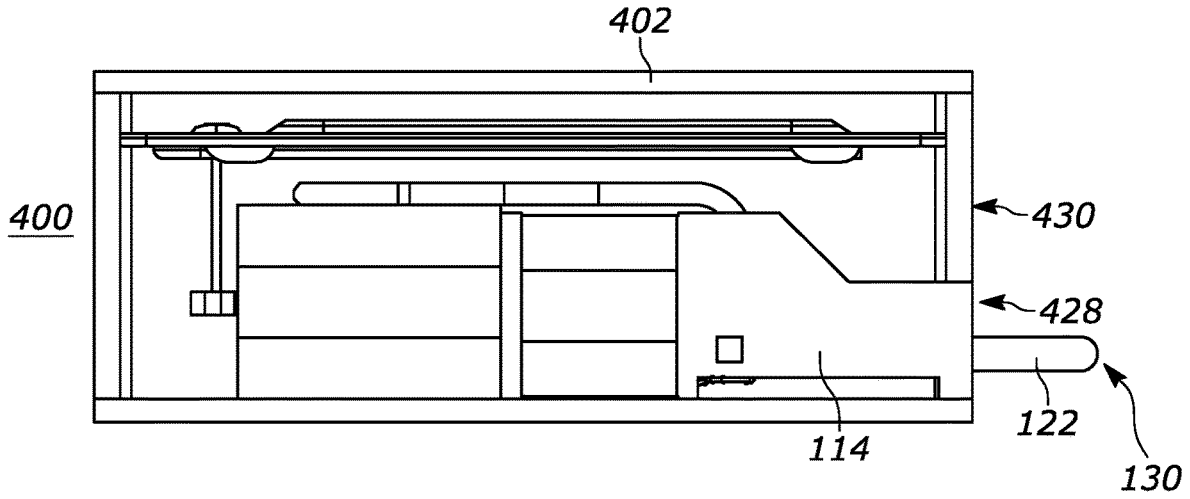
FIG. 8 is a side sectional view of the balanced armature receiver of FIG. 6.

In some embodiments, the bobbin 100 has a recess 142 between the coil support member 102 and the bottom portion 120 of the shoulder 114 such that the wire portions 202 and 204 extend along the recess. The recess may be defined as an indentation or a depression, for example, such that the recess is more recessed or depressed relative to an outer perimeter or outer portion of the flange 110, as shown in FIG. 1. The recess provides a passage for the coil wires to extend between the coil support member and the shoulder without contacting the housing wall portion when the bobbin 100 in fastened to the housing wall portion 412 as shown in FIGS. 4, 5 and 8.

Figure 7:
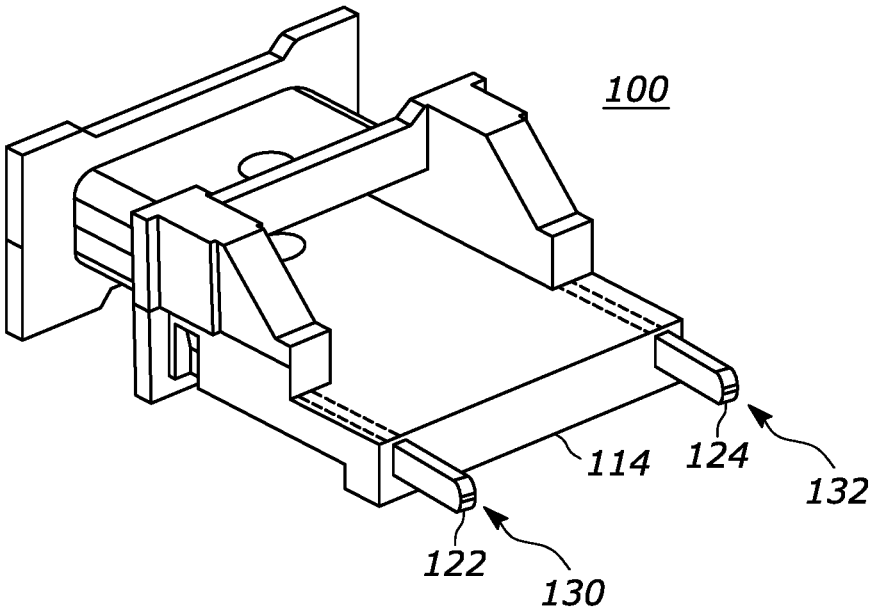
FIG. 7 is a perspective view of the bobbin in FIG. 6.
Figure 11:
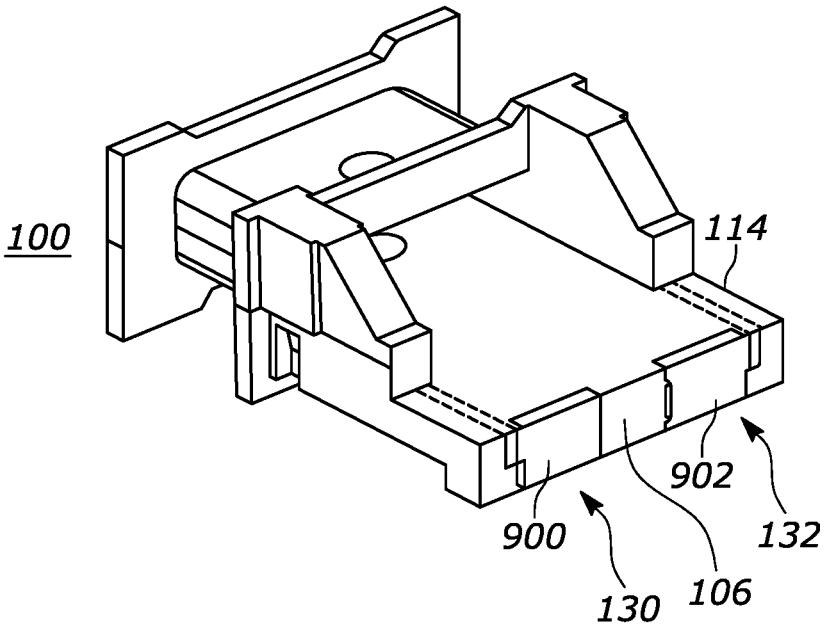
FIG. 11 is a perspective view of the bobbin in FIG. 9.

In FIGS. 7 and 11, the bobbin 100 is shown with the shoulder 114 extending further along the electrical terminals 122 and 124 than in previous examples. The electrical terminals are embedded in a portion of the shoulder 114 extending between the first flange 110 and the housing 402. The shoulder therefore surrounds more of the electrical terminals 122 and 124, allowing for greater support.

In FIG. 7, the second ends 130 and 132 of the electrical terminals 122 and 124 are straight and extend longitudinally from the shoulder 114. FIG. 11 shows a portion of the second ends 130 and 132 of the electrical terminals 122 and 124 to be bent to form bent portions 900 and 902 that are substantially flush with the shoulder 114 or protrude slightly from an outer surface of the housing sidewall.

FIGS. 4-6 and 8-10 illustrate examples of an acoustic receiver such as a balanced armature receiver 400 that includes the bobbin 100 described herein. The receiver has a housing 402 (e.g., a metal or plastic casing) with a sound port 404. A diaphragm 406 separates an internal volume of the housing into a back volume 408 and a front volume 410 such that the front volume is acoustically coupled with the sound port and the back volume at least partially contains a receiver motor 411. The motor 411 comprising the coil bobbin 100 is fastened to a bottom wall portion 412 of the housing 402. A bottom portion 120 of the shoulder is recessed relative to the outer portion 144 of the flange 110. The shoulder 114 also has the conductive coil pads 116 and 118, which are not visible in FIG. 4, disposed on the bottom portion 120. As shown, the bottom portion 120 of the shoulder 114 is not in direct contact with the bottom wall portion of the housing to prevent contact between the wire portions 202 and 204 and the housing wall, which may be conductive.

The receiver motor 411 also comprises a yoke 414 adjacent the bobbin 100, and an armature 416 extending through the armature passage of the bobbin. The yoke retains magnets 422 and 424 spaced apart by a gap 420. The armature has a stationary portion 417 fixed to the yoke and a movable portion 418 at least partially disposed in the gap. The receiver motor also includes a link 426 that interconnects the diaphragm 406 and the movable portion of the armature.

The housing 402 further includes an opening 428 through which a portion of each of the electrical terminals 122 and 124 extends or protrudes through to an external side 430 of the housing. The electrical terminals can be electrically coupled to a terminal board 432 located on an external side of the housing. The terminal board 432 can be located at or proximate the second ends 130 and 132 of the corresponding electrical terminals.

In some embodiments, the housing 402 further includes a sound tube or nozzle 434 acoustically coupled with the sound port 404. In some examples, the sound tube or nozzle extends longitudinally from the housing on an opposite side from the terminal board or the opening through which the electrical terminals at least partially extend. In some examples, the sound tube or nozzle is located on some other side of the housing.

In FIG. 5, the bobbin 100 is fastened to the bottom housing wall portion 412 to forma subassembly. The bobbin is oriented with the bottom portion of the shoulder facing the bottom housing wall portion and spaced apart from the bottom housing wall portion. The spacing permits placement of an insulating material 500 between the housing wall portion and the conductive coil pads. The insulating material covers the conductive coil pads and can also help fasten the bobbin to the housing wall portion. The insulating material can also be a silicone, epoxy, resin, hot-melt glue, rubber cement, ultraviolet-activated glue, or any other material with suitable insulating properties. An epoxy, adhesive or glue 502 between the coil and the housing wall portion can also help fasten the bobbin to the bottom housing wall portion. In FIG. 5, space between the bobbin and housing wall portion is exaggerated for illustration purposes. Other parts of the motor, like the yoke and armature, can be assembled after the bobbin is fastened to the housing wall portion.

Figure 6:
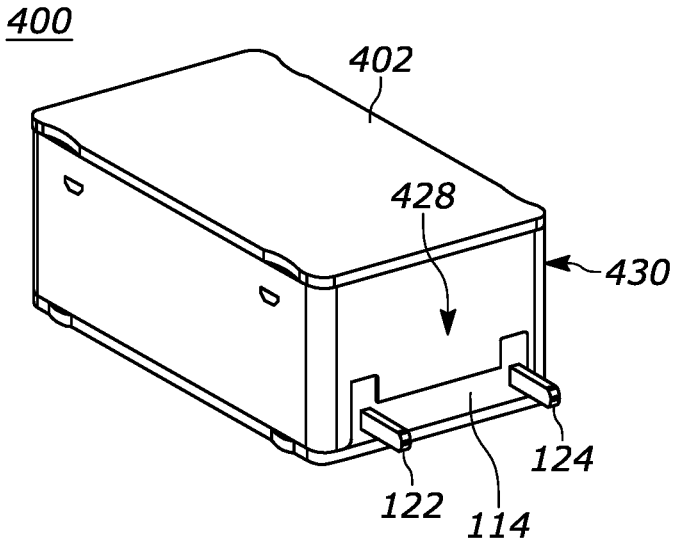
FIG. 6 is a perspective view of a balanced armature receiver including a bobbin according to some embodiments.

In FIGS. 6 and 8, the housing 402 includes an opening 428 through which portions of the electrical terminals 122 and 124 extend. The shoulder 114 also extends toward the opening such that the shoulder is adjacent to, or extends at least partially through, the opening. In the embodiment shown, portions of the electrical terminals that extend from the opening and shoulder can be configured to mate with an external device, like the external terminal board 432 shown in FIG. 4.

Figure 9:
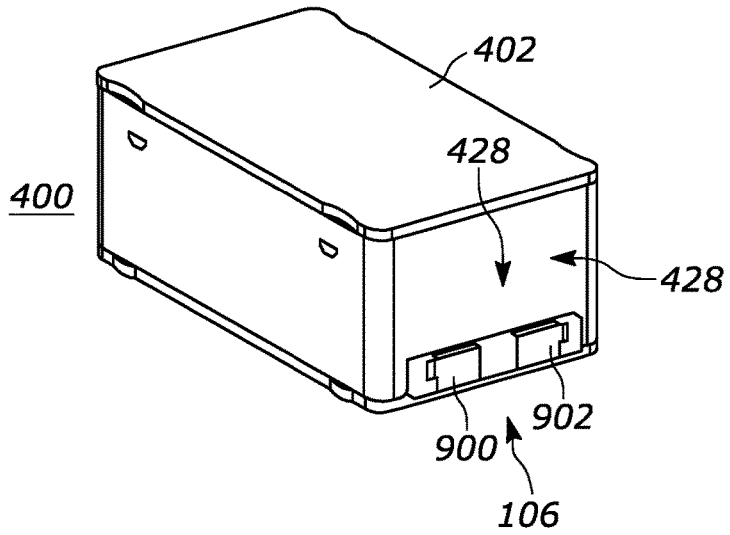
FIG. 9 is a perspective view of a balanced armature receiver implementing a bobbin according to some embodiments.
Figure 10:
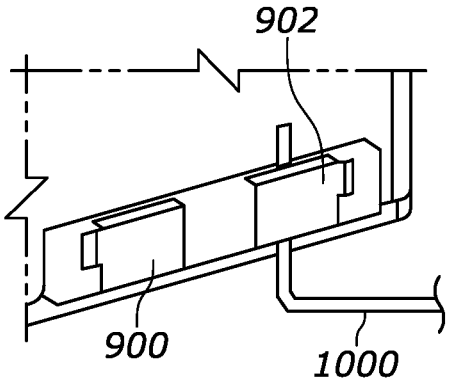
FIG. 10 is partial enlarged view of the balanced armature receiver of FIG. 9 with an electrical connector coupled therewith.

In FIGS. 9-11, portions 900 and 902 of the electrical terminals protrude externally from the housing 402. Each of the portions 900 and 902 is capable of slidably receiving and electrically coupling with an electrical connector 1000 of the external device between the bent portion and the shoulder of the bobbin. The shoulder can be recessed relative to the housing side wall so that the bent terminals are flush with an outer surface of housing side wall.

In one implementation, the coil bobbin includes a coil support member having an armature passage extending between a first and second ends thereof. The bobbin also includes at least a first and second flanges extending from the coil support member, the first flange is locate proximate the first end and the second flange is located proximate the second end. The bobbin also includes a shoulder extending from the first flange, wherein the first flange is located between the shoulder and the coil support member. A plurality of conductive coil pads are disposed on a bottom portion of the shoulder.

The bobbin can include a plurality of electrical terminals partially embedded in the shoulder. Each electrical terminal can include a first end including one of the plurality of conductive coil pads and a second end extending longitudinally from the shoulder. In these and other embodiments, the shoulder surrounds all sides of a portion of each electrical terminal. The electrical terminals can be located on opposite sides of the armature passage. The shoulder and the coil support member constitute an unassembled unitary body member comprising a non-conductive material like plastic.

A coil is generally disposed about the coil support member of the bobbin between the first and second flanges. The coil includes two wire portions electrically coupled to corresponding conductive coil pads located on a bottom portion of the shoulder. The first flange can includes a recess between the coil support member and the bottom portion of the shoulder, wherein the two wire portions extend along the recess.

The bobbin can be combined with a housing wall portion to form a subassembly. The bobbin is fastened to the housing wall portion, like a sidewall plate, and oriented with the bottom portion of the shoulder facing and spaced apart from the housing wall portion. The bobbin may have an insulating material covering the conductive coil pads where the wire portions are electrically coupled. The insulating material can be used in receivers susceptible to corrosive environments. The insulating material can be a glue or epoxy or other adhesive that fastens the coil and bobbin assembly to the housing wall portion.

In another implementation, the bobbin is further implemented in combination with a motor having an armature having a portion extending through the armature passage of bobbin and a yoke retaining magnets spaced apart by a gap. A stationary portion of the armature is fixed to the yoke and a movable portion of the armature is at least partially disposed in the gap. A diaphragm is also disposed within a housing including the housing wall portion, the diaphragm separating the housing into a back volume and a front volume including a sound port, wherein the motor is disposed in the back volume. A link interconnects the diaphragm and the movable portion of the armature, with the plurality of electrical terminals protruding through an opening in the housing.

In some embodiments, the electrical terminals are embedded in a portion of the shoulder extending between the first flange and the housing sidewall. In some receivers including such a bobbin, portions of the electrical terminals that protrude externally from the shoulder of the bobbin can be bent substantially flush with the shoulder.

The present disclosure also pertains to balanced armature receivers that implement the aforementioned bobbins and variations thereof. The receiver includes a housing having a sound port, a diaphragm disposed in the housing and separating the housing into a back volume and a front volume acoustically coupled to the sound port, and the aforementioned bobbin. The bobbin is disposed in the back volume and fastened to a wall portion of the housing. The bobbin includes a coil support member having a first flange spaced apart from a second flange. The bobbin also has a shoulder extending from the coil support member, wherein the shoulder has a bottom portion recessed relative to an outer portion of the first flange. The bobbin also has a plurality of conductive coil pads disposed on the bottom portion of the shoulder.

The receiver further includes a coil disposed about the coil support member of the bobbin between the first flange and the second flange, the coil having two wire portions extending along a recess in the first flange and electrically coupled to corresponding conductive coil pads. Furthermore, the receiver includes a yoke disposed in the back volume adjacent the bobbin, an armature extending through an armature passage of the bobbin and having a movable portion disposed in a gap between magnets retained by the yoke, and a link connecting the movable portion of the armature to the diaphragm.

In some embodiments according to the above implementation with the receiver, an insulating material is disposed between the bottom portion of the shoulder and the wall portion of the housing. The insulating material covers the plurality of conductive coil pads where the two wire portions are electrically coupled. In some examples of the embodiments, the insulating material is an adhesive material attaching the bobbin to the housing.

In some other embodiments according to the above implementation with the receiver, a plurality of electrical terminals are partially embedded in the shoulder of the bobbin, and each of the plurality of electrical terminals has a first end including one of the plurality of conductive coil pads and a second end extending longitudinally from the shoulder and through an opening in the housing.

In some examples of the embodiments, the shoulder of the bobbin surrounds all sides of a portion of each of the electrical terminals. In another example of the embodiments, the shoulder of the bobbin extends into the opening of the housing and portions of the electrical terminals protrude through the shoulder to an external side of the housing. In yet another example of the embodiments, each portion of the electrical terminals that protrudes externally from the housing is bent to be substantially flush with the shoulder of the bobbin. In yet another example of the embodiments, each bent portion of the electrical terminals is configured to slidably receive an electrical connector between the bent portion and the shoulder of the bobbin. In one example of the embodiments, the plurality of electrical terminals include a first terminal located on a first side of the armature passage and a second terminal located on a second side, opposite the first side, of the armature passage.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

What is claimed is:

1. A balanced armature receiver bobbin comprising:

a coil support member having an armature passage extending between a first end and a second end thereof;

at least a first flange and a second flange extending from the coil support member, the first flange extending from the coil support member proximate the first end and the second flange extending from the coil support member proximate the second end; and a shoulder extending from the first flange, with the first flange located between the shoulder and the coil support member, the shoulder having a plurality of conductive coil pads disposed on a bottom portion thereof.

2. The bobbin of claim 1, wherein the bobbin further comprises a plurality of electrical terminals partially embedded in the shoulder, and each of the plurality of electrical terminals has a first end comprising one of the plurality of conductive coil pads and a second end extending longitudinally from the shoulder.

3. The bobbin of claim 2, wherein the shoulder surrounds all sides of a portion of each of the plurality of electrical terminals.

4. The bobbin of claim 3, wherein the plurality of electrical terminals comprise a first terminal located on a first side of the armature passage and a second terminal located on a second side, opposite the first side, of the armature passage.

5. The bobbin of claim 4, wherein the shoulder and the coil support member constitute an unassembled unitary member comprising a non-conductive material.

6. The bobbin of claim 4, wherein each portion of the electrical terminals that protrudes externally from the shoulder of the bobbin is bent to be substantially flush with the shoulder of the bobbin.

7. The bobbin of claim 1, wherein the bobbin further comprises a coil disposed about the coil support member between the first flange and the second flange, the coil having two wire portions and each of the two wire portions electrically coupled to a corresponding one of the plurality of conductive coil pads.

8. The bobbin of claim 7, wherein the first flange includes a recess between the coil support member and the bottom portion of the shoulder, wherein the two wire portions extend along the recess.

9. The bobbin of claim 8, wherein the bobbin is configured to be fastened to a housing wall portion, the bobbin oriented with the bottom portion of the shoulder facing and spaced apart from the housing wall portion, the bobbin further comprising an insulating material covering the conductive coil pads where the wire portions are electrically coupled.

10. The bobbin of claim 9, wherein electrical terminals are embedded in a portion of the shoulder extending between the first flange and the housing wall portion.

11. A balanced armature receiver comprising:

a housing having a sound port;

a diaphragm disposed in the housing and separating the housing into a back volume and a front volume acoustically coupled to the sound port;

a bobbin disposed in the back volume and fastened to a wall portion of the housing, the bobbin including a coil support member having a first flange spaced apart from a second flange, a shoulder extending from the coil support member, the shoulder having a bottom portion recessed relative to an outer portion of the first flange, and a plurality of conductive coil pads disposed on the bottom portion of the shoulder;

a coil disposed about the coil support member of the bobbin between the first flange and the second flange, the coil having two wire portions extending along a recess in the first flange and electrically coupled to corresponding conductive coil pads; and a yoke disposed in the back volume adjacent the bobbin;

an armature extending through an armature passage of the bobbin and having a movable portion disposed in a gap between magnets retained by the yoke; and a link connecting the movable portion of the armature to the diaphragm.

12. The receiver of claim 11, further comprising an insulating material disposed between the bottom portion of the shoulder and the wall portion of the housing, the insulating material covering the plurality of conductive coil pads where the two wire portions are electrically coupled.

13. The receiver of claim 12, wherein the insulating material is an adhesive material attaching the bobbin to the housing.

14. The receiver of claim 11, further comprising a plurality of electrical terminals partially embedded in the shoulder of the bobbin, and each of the plurality of electrical terminals has a first end comprising one of the plurality of conductive coil pads and a second end extending longitudinally from the shoulder and through an opening in the housing.

15. The receiver of claim 14, wherein the shoulder of the bobbin surrounds all sides of a portion of each of the electrical terminals.

16. The receiver of claim 15, wherein the shoulder of the bobbin extends into the opening of the housing and portions of the electrical terminals protrude through the shoulder to an external side of the housing.

17. The receiver of claim 16, wherein each portion of the electrical terminals that protrudes externally from the housing is bent to be substantially flush with the shoulder of the bobbin.

18. The receiver of claim 17, wherein the each bent portion of the electrical terminals is configured to slidably receive an electrical connector between the bent portion and the shoulder of the bobbin.

19. The receiver of claim 14, wherein the plurality of electrical terminals comprise a first terminal located on a first side of the armature passage and a second terminal located on a second side, opposite the first side, of the armature passage.

* * * * *